US007384351B2

(12) United States Patent
Kasashima et al.

(10) Patent No.: US 7,384,351 B2
(45) Date of Patent: Jun. 10, 2008

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/283,754

(22) Filed: Nov. 22, 2005

(65) Prior Publication Data

US 2007/0117655 A1 May 24, 2007

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 5,601,503 A * 2/1997 Yamagishi et al. ..... 473/384
5,752,889 A * 5/1998 Yamagishi et al. ..... 473/377
5,993,332 A * 11/1999 Yamagishi et al. ..... 473/377
6,015,356 A * 1/2000 Sullivan et al. ..... 473/373
6,346,053 B1 * 2/2002 Inoue et al. ..... 473/378
6,659,889 B2 12/2003 Kasashima et al.
7,083,533 B2 8/2006 Kasashima et al.

FOREIGN PATENT DOCUMENTS

JP 2003-38681 A 2/2003
JP 2003-126301 A 5/2003

* cited by examiner

*Primary Examiner*—Raeann Trimiew
(74) *Attorney, Agent, or Firm*—Sughrue Mion, PLLC

(57) ABSTRACT

In a golf ball composed of a resilient solid core and a resin cover which encloses the core and has on an outside surface thereof numerous circular dimples, the cover has a maximum thickness of 0.5 to 1.5 mm and is made of a polyurethane elastomer having a Shore D hardness of 40 to 58; the total number of dimples on the cover is from 390 to 420, of which 40 to 80 are small-diameter dimples with a diameter of 2.0 to 2.7 mm; and the dimples are arranged so that total planar surfaces circumscribed by dimple edges which delineate boundaries between individual dimples and surrounding land areas that form an outermost surface of the ball account for 74 to 84% to an imaginary sphere defined by the surface of the ball having no dimples thereon. The golf ball of the invention does not readily lose lift even near the highest point in the trajectory of the ball when it has been hit, and thus can beneficially increase the distance of travel.

18 Claims, 8 Drawing Sheets

GOLF BALL

BACKGROUND OF THE INVENTION

The present invention relates to a golf ball having an excellent flight performance.

In the past, to improve both the feel of solid golf balls on impact and their controllability, such balls were optimized for properties such as core and cover hardness under high-trajectory conditions owing to a relatively high spin rate.

However, it was later found that a golf ball hit at a low spin and a high launch angle will travel a longer distance. Hence, greater effort has come to be devoted to increasing the distance of travel in a manner which is in keeping with these findings. With recent advances in golfing equipment such as balls and clubs, designs are being worked out on drivers and other golf clubs built for distance that greatly reduce the amount of backspin taken on by a golf ball when hit.

Under low-spin conditions, the ball that has been hit will have a small coefficient of drag, which tends to increase its distance of travel. Yet, when the dimples that have been used in earlier golf balls are used unchanged in these more advanced golf balls, a drop occurs due to insufficient lift in the region of diminishing speed after the highest point of the ball's trajectory, resulting in a loss of distance.

SUMMARY OF THE INVENTION

It is thus an object of the invention to provide a golf ball which, owing to the optimization of such ball characteristics as the total number of dimples arranged on a specific golf ball cover, the combination of large and small dimples, and the density of the dimple arrangement, does not readily lose lift even near the highest point in the trajectory of the ball during flight, and thus can beneficially increase the distance traveled by the ball.

We have conducted extensive investigations, as a result of which we have found that, with regard to circular dimples arranged on the surface of a golf ball, by using a plurality of dimple types of differing diameter within a fixed range in the total number of dimples and by arranging the dimples so that dimples of a relatively small diameter are included in a given amount and combined to a high density with dimples of a relatively large diameter, the distance traveled by the ball is increased and the flight performance is stabilized.

Accordingly, the invention provides the following golf balls.

[1] A golf ball composed of a resilient solid core and a resin cover which encloses the core and has on an outside surface thereof numerous circular dimples, the golf ball being characterized in that the cover has a maximum thickness of 0.5 to 1.5 mm and is made of a polyurethane elastomer having a Shore D hardness of 40 to 58; the total number of dimples on the cover is from 390 to 420, of which 40 to 80 are small-diameter dimples with a diameter of 2.0 to 2.7 mm; and the dimples are arranged so that total planar surfaces circumscribed by dimple edges which delineate boundaries between individual dimples and surrounding land areas that form an outermost surface of the ball account for 74 to 84% to an imaginary sphere defined by the surface of the ball having no dimples thereon.

[2] The golf ball of [1], wherein the dimples have diameters in a range of 2.0 to 4.5 mm.

[3] The golf ball of [2] which has from 200 to 290 large-diameter dimples with diameters of 3.8 to 4.5 mm.

[4] The golf ball of [1], wherein the dimples are of 4 to 20 types of differing diameter.

[5] The golf ball of [1], wherein the dimples are formed such that dimple margins which connect to land areas on the ball are circularly arcuate with a radius of curvature of from 0.3 to 2.0 mm.

BRIEF DESCRIPTION OF THE DIAGRAMS

DETAILED DESCRIPTION OF THE INVENTION

The invention is described more fully below in conjunction with the diagrams.

Figure 1:
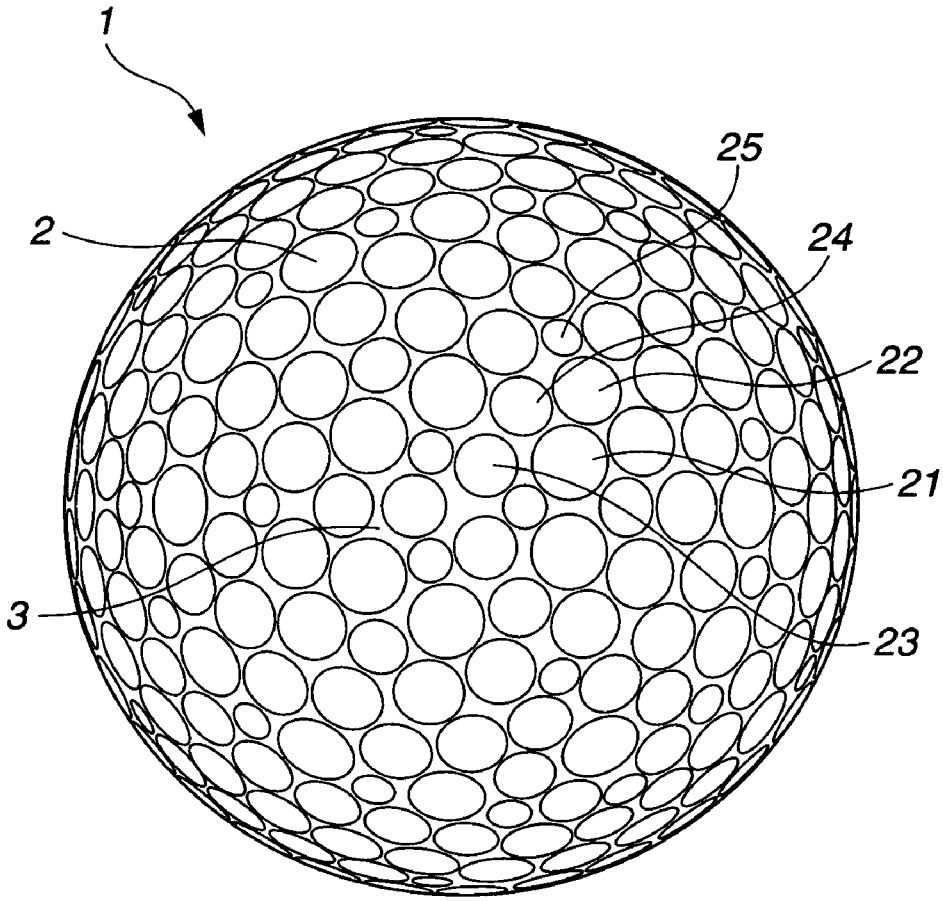
FIG. 1 is a top view of a golf ball according to a first embodiment of the invention.
Figure 2:
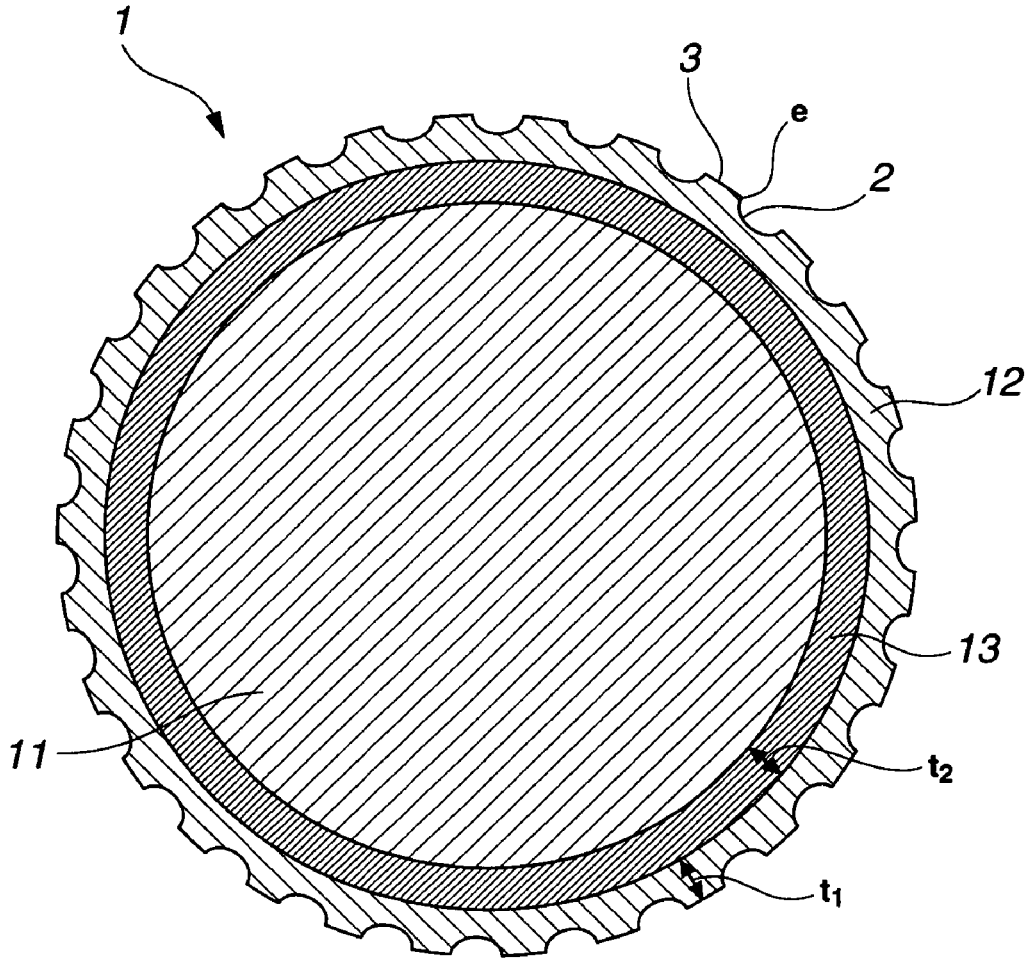
FIG. 2 is a sectional view showing the golf ball according to the same embodiment.
Figure 3:
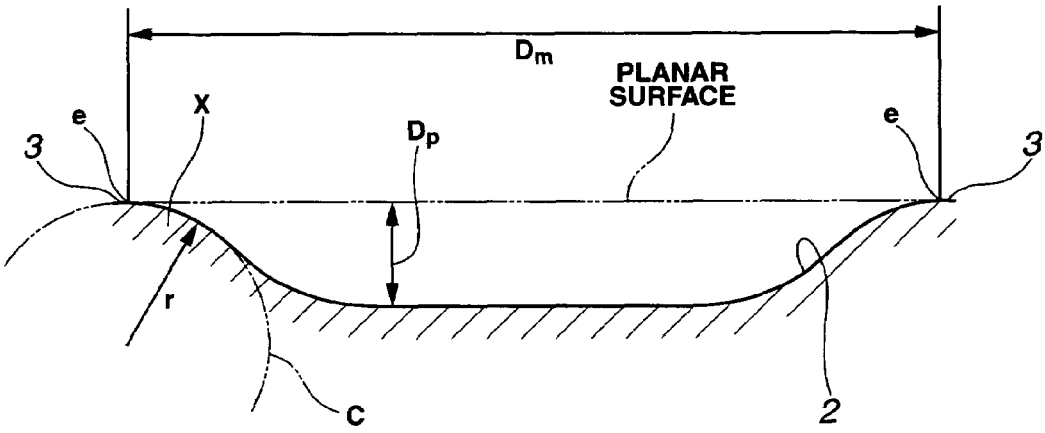
FIG. 3 is a sectional view of a dimple provided in the invention.

FIG. 1 is a top view of a golf ball according to a first embodiment of the invention, FIG. 2 is a sectional view of the same golf ball, and FIG. 3 is an enlarged sectional view of a dimple 2 on the golf ball 1 shown in FIGS. 1 and 2.

Referring to FIGS. 1 and 2, the golf ball 1 of the invention has a resilient solid core 11 disposed at the center by an ordinary method, and has a resin cover 12 which encloses the outside of the core 11 and has an outside surface thereof numerous circular dimples 2. In the example shown in FIG. 2, a single intermediate layer 13 made of resin is disposed between the solid core 11 and the cover 12.

The cover 12 is made of a polyurethane elastomer, has a maximum thickness $t_1$ of 0.5 to 1.5 mm, and has a Shore D hardness of 40 to 58. When the intermediate layer 13 shown in FIG. 2 is disposed between the core 11 and the cover 12, the material used to form the intermediate layer 13 may be, for example, an ionomer resin or a polyester elastomer.

The intermediate layer 13 in such a case may have a Shore D hardness of 45 to 65 and a thickness $t_2$ of 1.0 to 2.0 mm. It is preferable for the Shore D hardness of the intermediate layer 13 to be about the same as or higher (harder) than that of the cover 12.

A total of 390 to 420, and preferably 396 to 416 dimples 2, of which 40 to 80 are small-diameter dimples having a diameter of 2.0 to 2.7 mm, are uniformly arranged on the outside surface of the ball. At a total number of dimples greater than 420, a ball hit with a club designed for distance, such as a driver, will have too low a trajectory and thus be unable to achieve the desired distance. On the other hand, at a total number of dimples below 390, the trajectory rises too high and the variation in the carry of the ball tends to increase.

In the practice of the invention, letting the planar surface area of the circle circumscribed by a dimple edge e which delineates the boundary between a dimple 2 and a land area (the lands are the outer portions of the ball's surface except the dimples) 3 be s, the sum S of such surface areas for all the dimples on the ball, expressed as a ratio $S_R$ relative to the surface area T of an imaginary sphere defined by the surface of the ball were it to have no dimples thereon ($S_R$=S/T×100), is from 74 to 84%. In FIG. 3, this surface area s is the area of the planar surface circumscribed by a dimple edge e which delineates the boundary between the dimple 2 and surrounding land areas 3 that form substantially the outermost surface of the ball (i.e., the surface area of the planar surface which includes the straight line (indicated as a dash-dot-dot line) connecting both edges e of the dimple.

Referring to FIG. 1, the diameters and types of dimples 2 are as follows: a first type of dimple 21 is the largest (diameter, 4.36 mm; number, 48), a second type of dimple 22 is the second largest (diameter, 4.05 mm; number, 192), a third type of dimple 23 is the third largest (diameter, 3.67 mm; number, 78), a fourth type of dimple 24 is the fourth largest (diameter, 3.40 mm; number, 36), and a fifth type of dimple 25 is the smallest (diameter, 2.55 mm; number, 54). The total number of dimples is 408.

In the invention, it is preferable for a dimple margin X (a given region of the dimple that extends from the base or sidewall of the dimple to the dimple edge) connecting to surrounding land areas 3 to be formed so as to be circularly arcuate in cross-section with a radius of curvature r of from 0.3 to 2.0 mm. In FIG. 3, the cross-sectional shape of this region is superimposed on the circular arc C indicated by a dot-dot-dash line. By forming such circularly arcuate margins X as regions which connect to the land areas, the film of paint applied to the surface of the ball acquires a uniform thickness. As a result, the durability of the painted surface is enhanced, and the ball has a stable flight performance even when repeatedly hit many times.

In the practice of the invention, to enable the dimples to be arranged in a good balance and to suppress the variability of flight by the ball when hit, it is preferable for the dimple diameter $D_m$ to be from 2.0 to 4.5 mm. To improve the lift of the ball, it is desirable to include from 200 to 290 large-diameter dimples having a diameter of 3.8 to 4.5 mm.

With regard to the number of dimple types arranged on the outer surface of the ball, it is preferable to use at least 4 types but not more than 20 types of differing diameter within the above diameter range of 2.0 to 4.5 mm. With less than four dimple types of differing diameter, it is difficult to arrange the dimples on the outside surface of the ball in a good balance and to a high density (so that the ratio $S_R$ of the total surface area of the dimples to the outside surface overall is 74 to 84%). On the other hand, with more than 20 dimple types of differing diameter, the improvement in the density of the arrangement is too small to justify the additional difficulty encountered in mold fabrication.

Figure 4:
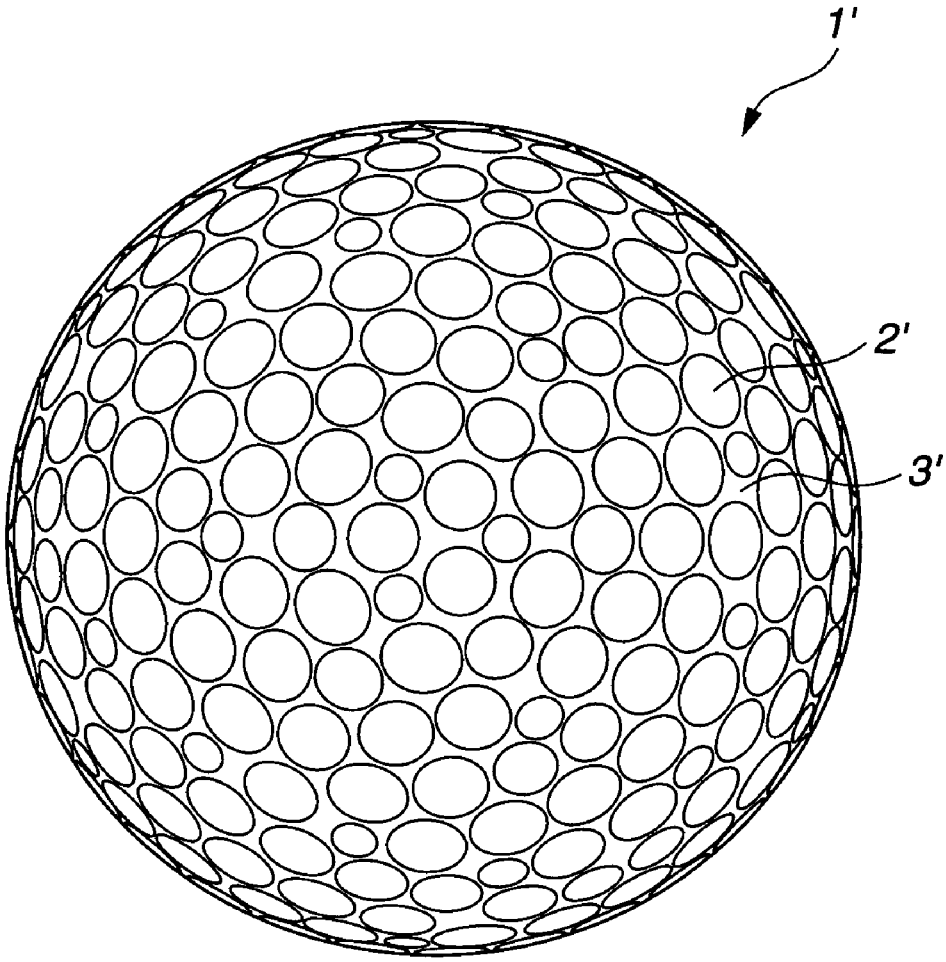
FIG. 4 is a top view of a golf ball according to a second embodiment of the invention.
Figure 5:
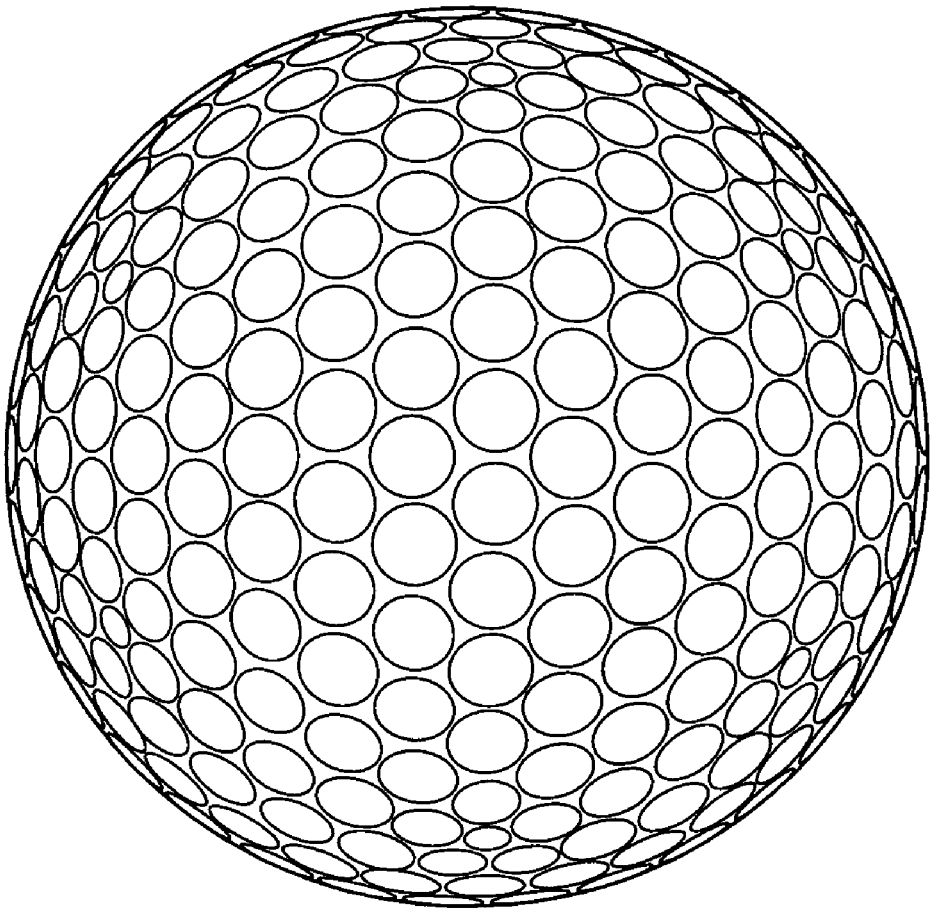
FIG. 5 is a top view of the golf ball in Comparative Example 1.
Figure 6:
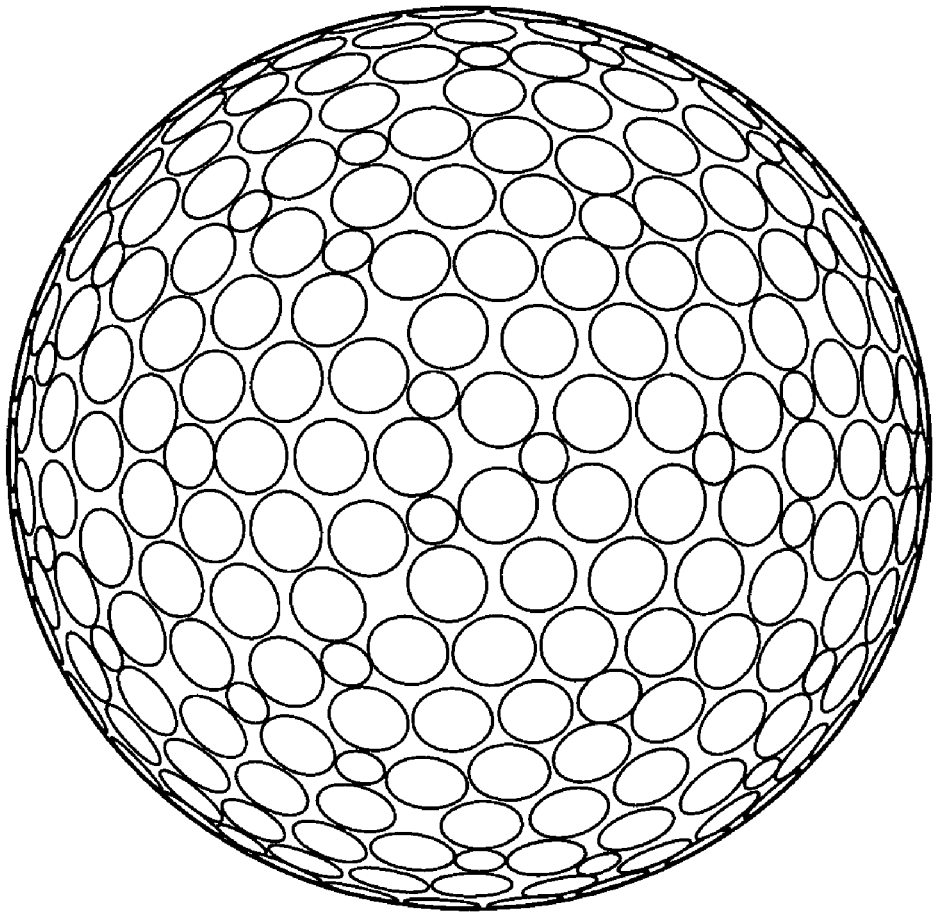
FIG. 6 is a top view of the golf ball in Comparative Example 2.
Figure 7:
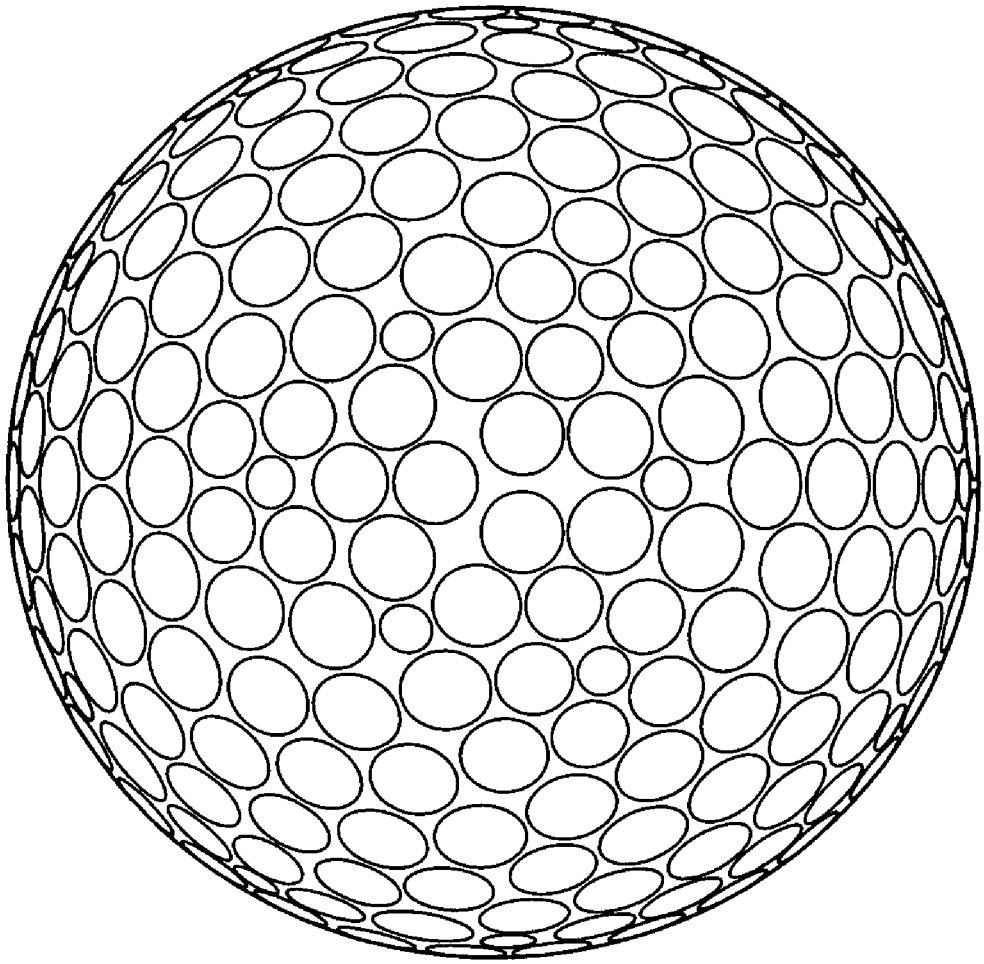
FIG. 7 is a top view of the golf ball in Comparative Example 3.

FIG. 4 is a top view of a golf ball 1' illustrating a second embodiment of the invention. FIG. 5 is a top view of the golf ball obtained in Comparative Example 1, FIG. 6 is a top view of the golf ball obtained in Comparative Example 2, and FIG. 7 is a top view of the golf ball obtained in Comparative Example 3.

EXAMPLES

The dimple arrangement diagrams, number of dimples, and various parameters of each type of dimple for the golf balls obtained in the respective Examples of the invention and Comparative Examples are presented in Table 1 below. The symbols representing dimple characteristics in the top line of Table 1 are explained below.

$V_o$

Figure 8:
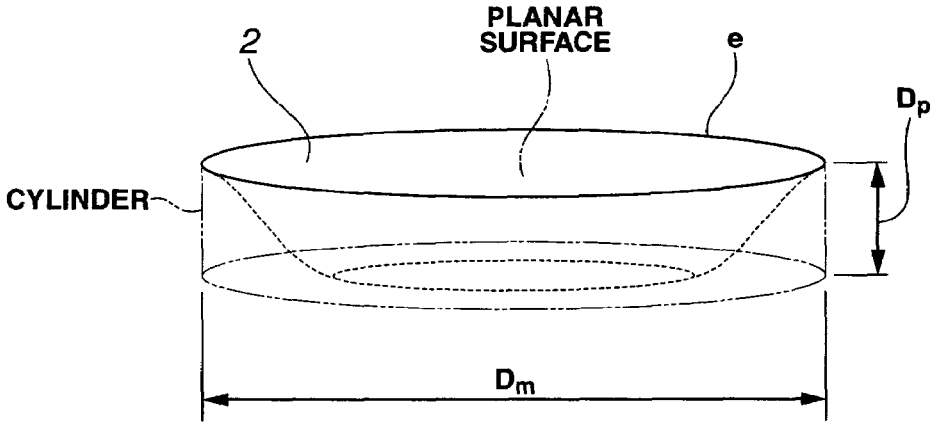
FIG. 8 is a schematic perspective view illustrating the shape of a dimple provided in the invention.

Referring to FIGS. 3 and 8, $V_o$ is the value obtained by dividing the volume of the dimple space under the planar surface circumscribed by the dimple edge e by the volume of a cylinder whose base is the planar surface and whose height is the maximum depth $D_p$ from the bottom of the dimple to the planar surface. Numerical values within parentheses are averages for all dimples.

$V_s$ $V_s$ is the overall volume of a dimple space under the planar surface circumscribed by the dimple edge e. Values in parentheses are the sum of the volumes for all dimples.

r

The symbol r represents the radius of curvature at the dimple margin (FIG. 3) before a finish coating is applied to the golf ball.

$S_R$ $S_R$ is the area of the dimple surfaces (planar surfaces circumscribed by dimple edges e) summed over the entire outside surface of the ball and expressed as a ratio relative to the surface area of an imaginary sphere defined by the surface of the ball having no dimples thereon.

TABLE 1

| | | Corresponding diagram | Number of dimples | Diameter (mm) | Depth (mm) | $V_o$ | $V_s$ | r (mm) | $S_R$ (%) |
|---|---|---|---|---|---|---|---|---|---|
| Example | 1 | FIG. 1 | 48 | 4.36 | 0.159 | 0.474 | 1.130 | 1.0 | 80.6 |
| | | | 192 | 4.05 | 0.146 | 0.468 | 0.880 | 1.0 | |
| | | | 78 | 3.67 | 0.148 | 0.463 | 0.723 | 1.0 | |
| | | | 36 | 3.40 | 0.145 | 0.454 | 0.598 | 1.0 | |
| | | | 54 | 2.55 | 0.096 | 0.419 | 0.206 | 1.0 | |
| | | | Total: 408 | | | (0.456) | (312.3) | | |
| | 2 | FIG. 4 | 12 | 4.36 | 0.172 | 0.475 | 1.220 | 0.5 | 75.1 |
| | | | 240 | 3.91 | 0.163 | 0.469 | 0.918 | 0.5 | |
| | | | 54 | 3.67 | 0.158 | 0.455 | 0.760 | 0.5 | |
| | | | 48 | 3.38 | 0.145 | 0.452 | 0.588 | 0.5 | |
| | | | 48 | 2.52 | 0.095 | 0.425 | 0.201 | 0.5 | |
| | | | Total: 402 | | | (0.455) | (313.9) | | |
| Comparative Example | 1 | FIG. 5 | 150 | 4.02 | 0.152 | 0.468 | 0.903 | 0.5 | 81.4 |
| | | | 192 | 3.83 | 0.145 | 0.453 | 0.757 | 0.5 | |
| | | | 60 | 3.22 | 0.138 | 0.448 | 0.503 | 0.5 | |

TABLE 1-continued

| | Corresponding diagram | Number of dimples | Diameter (mm) | Depth (mm) | $V_o$ | $V_s$ | r (mm) | $S_R$ (%) |
|---|---|---|---|---|---|---|---|---|
| | | 12 | 2.53 | 0.095 | 0.421 | 0.201 | 0.5 | |
| | Total: | 414 | | | (0.448) | (313.3) | | |
| 2 | FIG. 6 | 348 | 3.88 | 0.148 | 0.478 | 0.836 | <0.1 | 80.3 |
| | | 12 | 2.95 | 0.125 | 0.432 | 0.369 | <0.1 | |
| | | 12 | 3.43 | 0.132 | 0.442 | 0.539 | <0.1 | |
| | | 60 | 2.48 | 0.092 | 0.421 | 0.187 | <0.1 | |
| | Total: | 432 | | | (0.443) | (313.2) | | |
| 3 | FIG. 7 | 12 | 4.36 | 0.165 | 0.482 | 1.187 | 0.5 | 75.8 |
| | | 240 | 4.05 | 0.161 | 0.465 | 0.964 | 0.5 | |
| | | 6 | 3.91 | 0.152 | 0.458 | 0.836 | 0.5 | |
| | | 84 | 3.58 | 0.138 | 0.452 | 0.628 | 0.5 | |
| | | 30 | 2.53 | 0.102 | 0.436 | 0.224 | 0.5 | |
| | Total: | 372 | | | (0.459) | (310.2) | | |

In connection with the dimple values shown in Table 1, a dimple depth of from 0.08 to 0.25 mm is preferred, an average value $V_o$ of 0.4 to 0.6 is preferred, and an overall dimple volume $V_s$ of 270 to 350 $mm^3$ is preferred.

Next, to evaluate the flight performances of the golf balls (all having a diameter of 42.7 mm) obtained in Examples 1 and 2 of the invention and in Comparative Examples 1 to 3, the distances traveled by the balls when hit were tested. All of the balls had the following materials and construction.

Solid Core

The solid core was formed as a single layer of polybutadiene rubber. The solid core had a deflection, as measured by placing the core on a hard plate, applying an initial load of 10 kg, then increasing the load from this state to 130 kg, of 2.98 mm Cover A thermoplastic polyurethane elastomer was used as the cover material, and the cover was formed to a thickness ($t_1$) of 1.0 mm. The cover had a shore D hardness of 50.

Intermediate Layer

A three-layer construction was used in which one intermediate layer composed of an ionomer resin was placed between the cover and the core. The intermediate layer had a thickness ($t_2$) of 1.7 mm and a shore D hardness of 64.

Ten balls obtained from each of Examples 1 and 2 and Comparative Examples 1 to 3 were hit at a head speed of 45 m/s with a driver (W#1) mounted on a swing robot, and the distance traveled by the ball was measured. The average values obtained in each example are shown in Table 2.

TABLE 2

| | | Example | | Comparative Example | | |
|---|---|---|---|---|---|---|
| | | 1 | 2 | 1 | 2 | 3 |
| Distance traveled (m) | Carry | 221 | 220 | 216 | 215 | 220 |
| | Total distance | 235 | 232 | 230 | 228 | 227 |

The invention claimed is:

1. A golf ball comprising a resilient solid core and a resin cover which encloses the core and has on an outside surface thereof numerous circular dimples, the golf ball being characterized in that the cover has a maximum thickness of 0.5 to 1.5 mm and is made of a polyurethane elastomer having a Shore D hardness of 40 to 58; the total number of dimples on the cover is from 390 to 420, of which 40 to 80 are small-diameter dimples with a diameter of 2.0 to 2.7 mm; and the dimples are arranged so that total planar surfaces circumscribed by dimple edges which delineate boundaries between individual dimples and surrounding land areas that form an outermost surface of the ball account for 74 to 84% to an imaginary sphere defined by the surface of the ball having no dimples thereon;

wherein an intermediate layer made of resin is disposed between the solid core and the cover, and the intermediate layer has a Shore D hardness of 45 to 65.

2. The golf ball of claim 1, wherein the dimples have diameters in a range of 2.0 to 4.5 mm.

3. The golf ball of claim 2 which has from 200 to 290 large-diameter dimples with diameters of 3.8 to 4.5 mm.

4. The golf ball of claim 1, wherein the dimples are of 4 to 20 types of differing diameter.

5. The golf ball of claim 1, wherein the dimples are formed such that dimple margins which connect to the land areas on the ball are circularly arcuate with a radius of curvature of from 0.3 to 2.0 mm.

6. The golf ball of claim 1, wherein a plurality of the dimples include planar base surfaces.

7. The golf ball of claim 1, wherein the dimples have a depth of from 0.08 to 0.25 mm.

8. The golf ball of claim 1, wherein an average value $V_0$ of the dimples is 0.4 to 0.6, wherein $V_0$ is the value obtained by dividing a volume of dimple space under the planar surface circumscribed by the dimple edge by a volume of a cylinder whose base is the planar surface and whose height is a maximum depth from the bottom of the dimple to the planar surface.

9. The golf ball of claim 1, wherein an overall dimple volume $V_s$ is 270 to 350 $mm^3$, wherein $V_s$ is a volume of a dimple space under the planar surface circumscribed by the dimple edge.

10. A golf ball comprising a resilient solid core and a resin cover which encloses the core and has on an outside surface thereof numerous circular dimples, the golf bail being characterized in that the cover has a maximum thickness of 0.5 to 1.5 mm and is made of a polyurethane elastomer having a Shore D hardness of 40 to 58; the total number of dimples on the cover is from 390 to 420, of which 40 to 80 are small-diameter dimples with a diameter of 2.0 to 2.7 mm; and the dimples are arranged so that total planar surfaces circumscribed by dimple edges which delineate boundaries between individual dimples and surrounding an outermost surface of the bail account for 74 to 84% to an imaginary sphere defined by the surface of the ball having no dimples thereon, wherein an intermediate layer made of resin is disposed between the solid core and the cover, and the Shore D hardness of the intermediate layer is substantially the same as or higher than that of the cover.

11. The golf ball of claim 10, wherein the dimples have diameters in a range of 2.0 to 4.5 mm.

12. The golf ball of claim 11 which has from 200 to 290 large-diameter dimples with diameters of 3.8 to 4.5 mm.

13. The golf ball of claim 10, wherein the dimples are of 4 to 20 types of differing diameter.

14. The golf ball of claim 10, wherein the dimples are formed such that dimple margins which connect to the land areas on the ball are circularly arcuate with a radius of curvature of from 0.3 to 2.0 mm.

15. The golf ball of claim 10, wherein a plurality of the dimples include planar base surfaces.

16. The golf ball of claim 10, wherein the dimples have a depth of from 0.08 to 0.25 mm.

17. The golf ball of claim 10, wherein an average value $V_0$ of the dimples is 0.4 to 0.6, wherein $V_0$ is the value obtained by dividing a volume of dimple space under the planar surface circumscribed by the dimple edge by a volume of a cylinder whose base is the planar surface and whose height is a maximum depth from the bottom of the dimple to the planar surface.

18. The golf ball of claim 10, wherein an overall dimple volume $V_s$ is 270 to 350 $mm^3$, wherein $V_s$ is a volume of a dimple space under the planar surface circumscribed by the dimple edge.

* * * * *